US011029033B2

(12) United States Patent
Je et al.

(10) Patent No.: US 11,029,033 B2
(45) Date of Patent: Jun. 8, 2021

(54) COOKER

(71) Applicant: SAMSUNG ELECTRONICS CO., LTD., Suwon-si (KR)

(72) Inventors: Ji-Woon Je, Suwon-si (KR); Han Seong Kang, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 204 days.

(21) Appl. No.: 16/066,510

(22) PCT Filed: Jan. 10, 2017

(86) PCT No.: PCT/KR2017/000327
§ 371 (c)(1),
(2) Date: Jun. 27, 2018

(87) PCT Pub. No.: WO2017/122986
PCT Pub. Date: Jul. 20, 2017

(65) Prior Publication Data

US 2019/0003716 A1 Jan. 3, 2019

(30) Foreign Application Priority Data

Jan. 11, 2016 (KR) ..... 10-2016-0002998

(51) Int. Cl.
*F24C 7/04* (2021.01)
*B21D 53/74* (2006.01)
(Continued)

(52) U.S. Cl.
CPC ..... *F24C 7/043* (2013.01); *B21D 53/74* (2013.01); *C23D 5/00* (2013.01); *F24C 7/04* (2013.01);
(Continued)

(58) Field of Classification Search
CPC .. F24C 7/046; F24C 7/04; F24C 7/081; F24C 7/08; F24C 15/08; F24C 15/10;
(Continued)

(56) References Cited

U.S. PATENT DOCUMENTS 3,792,522 A 2/1974 Gray et al.
2015/0201465 A1* 7/2015 Adelmann ..... F24C 15/10 219/461.1

FOREIGN PATENT DOCUMENTS

DE 10 2008 042 670 A1 4/2010
DE 10 2014 209 955 A1 11/2015
(Continued)

OTHER PUBLICATIONS

International Search Report dated Apr. 25, 2017 in corresponding International Patent Application No. PCT/KR2017/000327.
(Continued)

*Primary Examiner* — Shawntina T Fuqua
(74) *Attorney, Agent, or Firm* — Staas & Halsey LLP

(57) ABSTRACT

Provided is a cooker which has a frame forming a side plate, which can be easily manufactured and can reduce manufacturing cost. The cooker includes a cooktop assembly for cooking and directly heating a container in which food is accommodated. The cooktop assembly includes a side plate having at least two frames coupled to each other, and a top plate located at an upper portion of the side plate.

16 Claims, 6 Drawing Sheets

(51) Int. Cl.

| | |
|---|---|
| ***F24C 15/08*** | (2006.01) |
| ***F24C 7/08*** | (2006.01) |
| ***C23D 5/00*** | (2006.01) |
| ***F24C 15/10*** | (2006.01) |

(52) U.S. Cl.
CPC ..... *F24C 7/08* (2013.01); *F24C 15/08* (2013.01); *F24C 15/10* (2013.01); *F24C 7/081* (2013.01); *F24C 15/102* (2013.01)

(58) Field of Classification Search
CPC ..... F24C 15/102; B21D 53/74; C23D 5/00; H05B 3/748; H05B 3/74; H05B 6/124; H05B 2206/022; A47B 77/08; Y02B 40/126
See application file for complete search history.

(56) References Cited

FOREIGN PATENT DOCUMENTS

| | | |
|---|---|---|
| JP | 2009-216316 | 9/2009 |
| JP | 2014-228162 | 12/2014 |
| JP | 2015-207356 | 11/2015 |
| KR | 10-2006-0075155 | 7/2006 |
| KR | 10-0826701 | 4/2008 |

OTHER PUBLICATIONS

Written Opinion of the International Searching Authority dated Apr. 25, 2017 in corresponding International Patent Application No. PCT/KR2017/000327.
Extended European Search Report dated Dec. 7, 2018 from European Patent Application No. 17738615.8, 10 pages.
European Office Action dated Nov. 10, 2020 from European Application No. 17738615.8, 6 pages.

* cited by examiner

[Fig. 1]
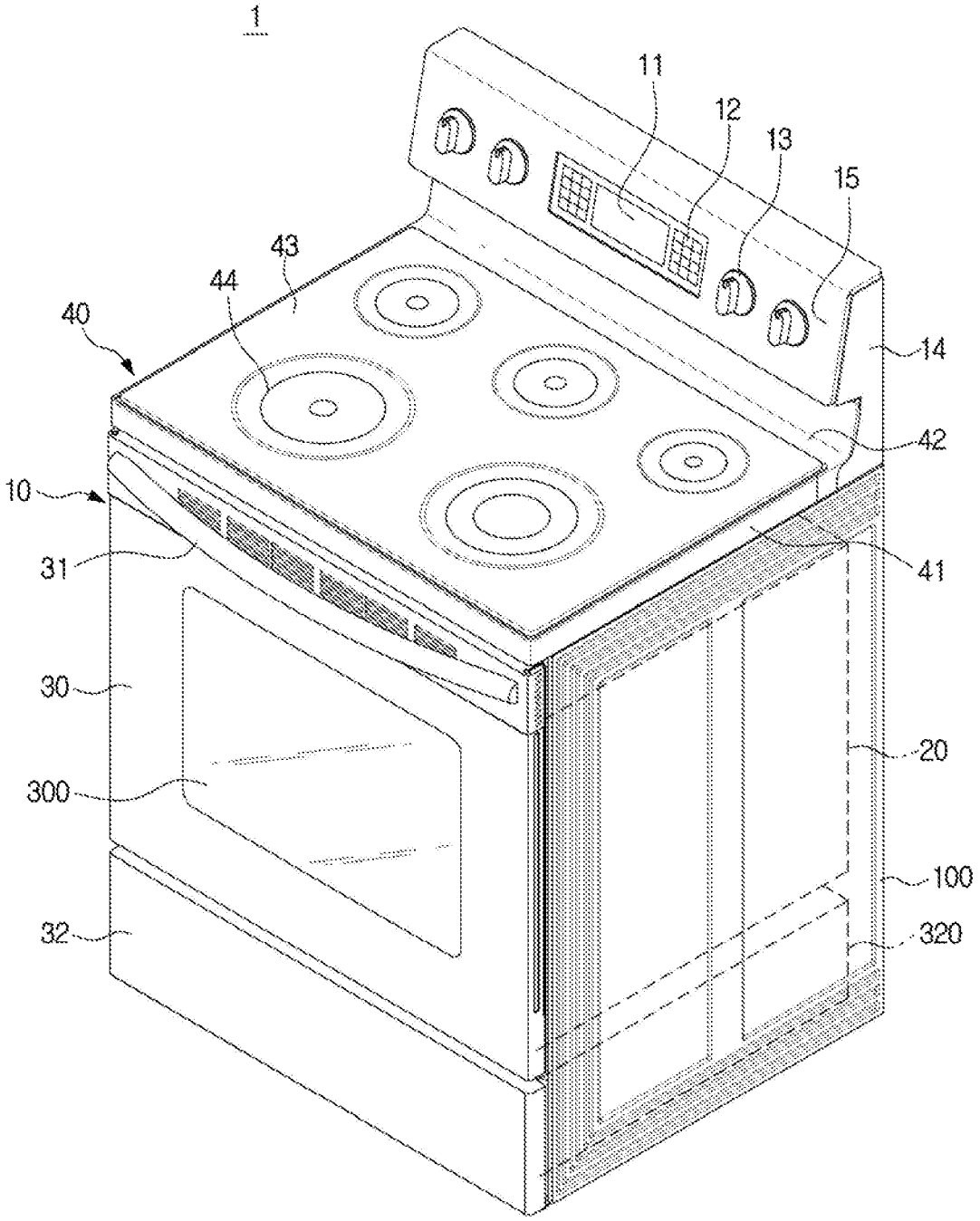

[Fig. 2]
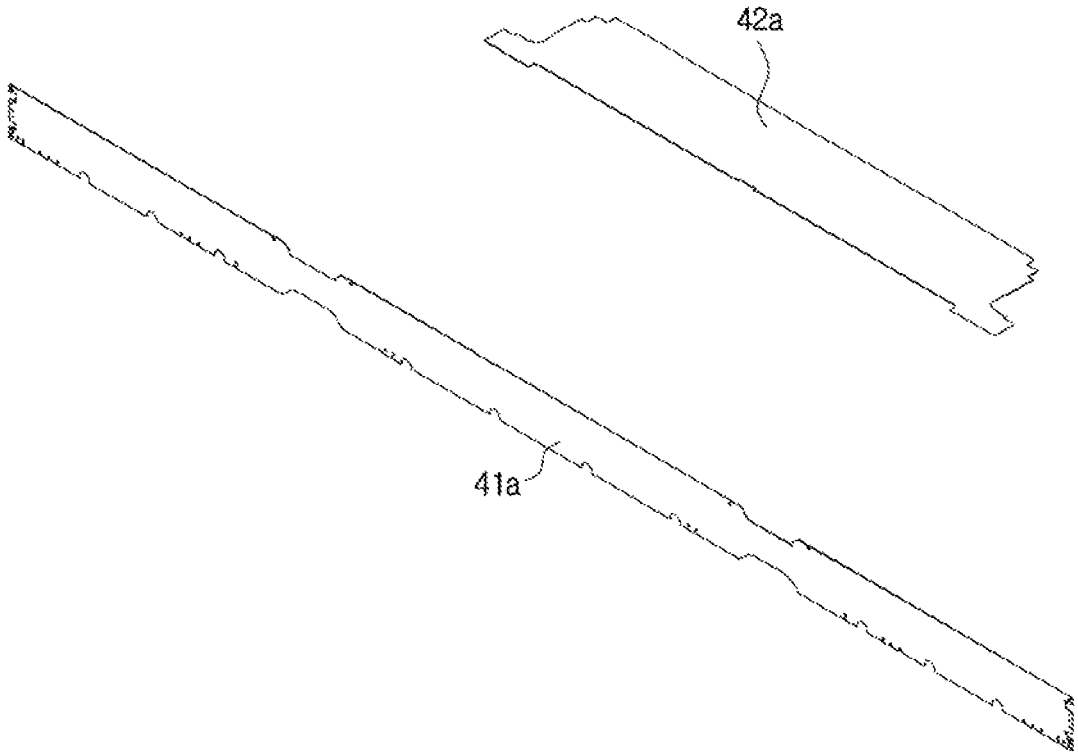

[Fig. 3]
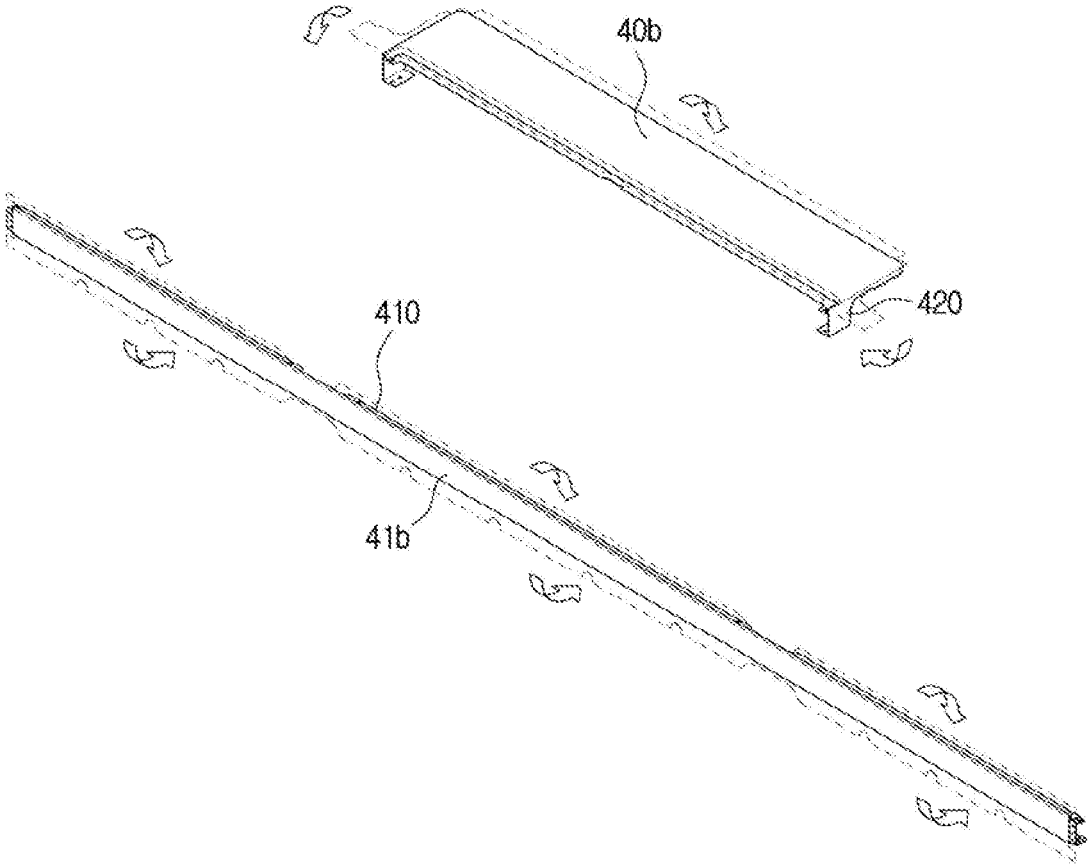

[Fig. 4]
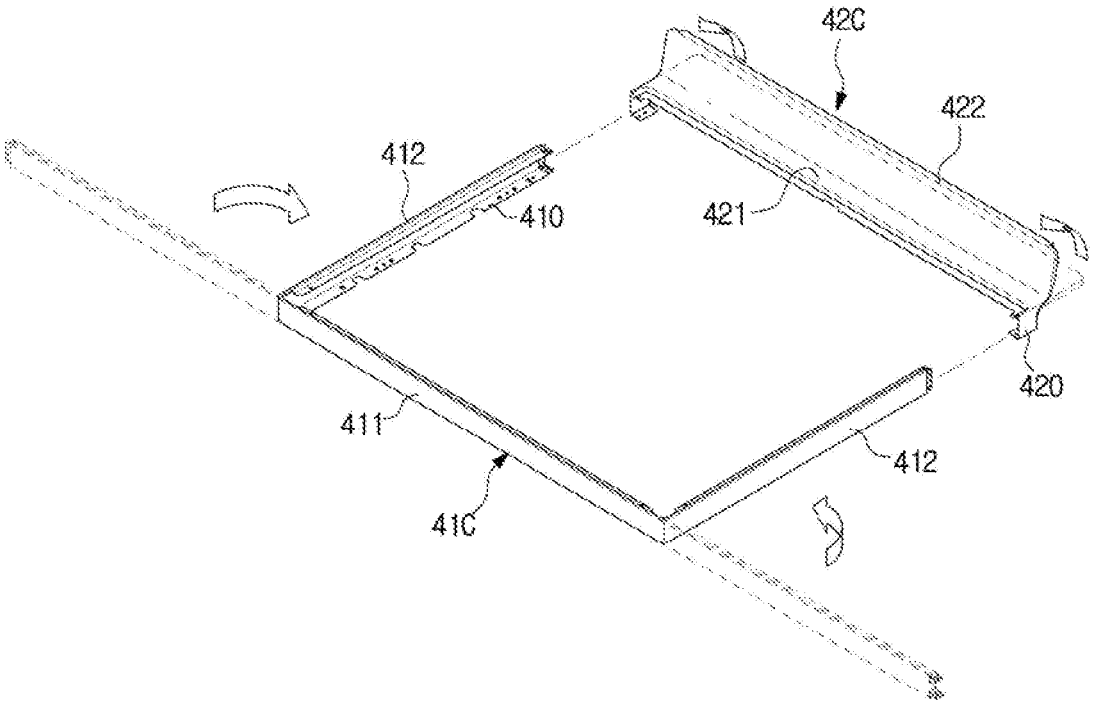

[Fig. 5]
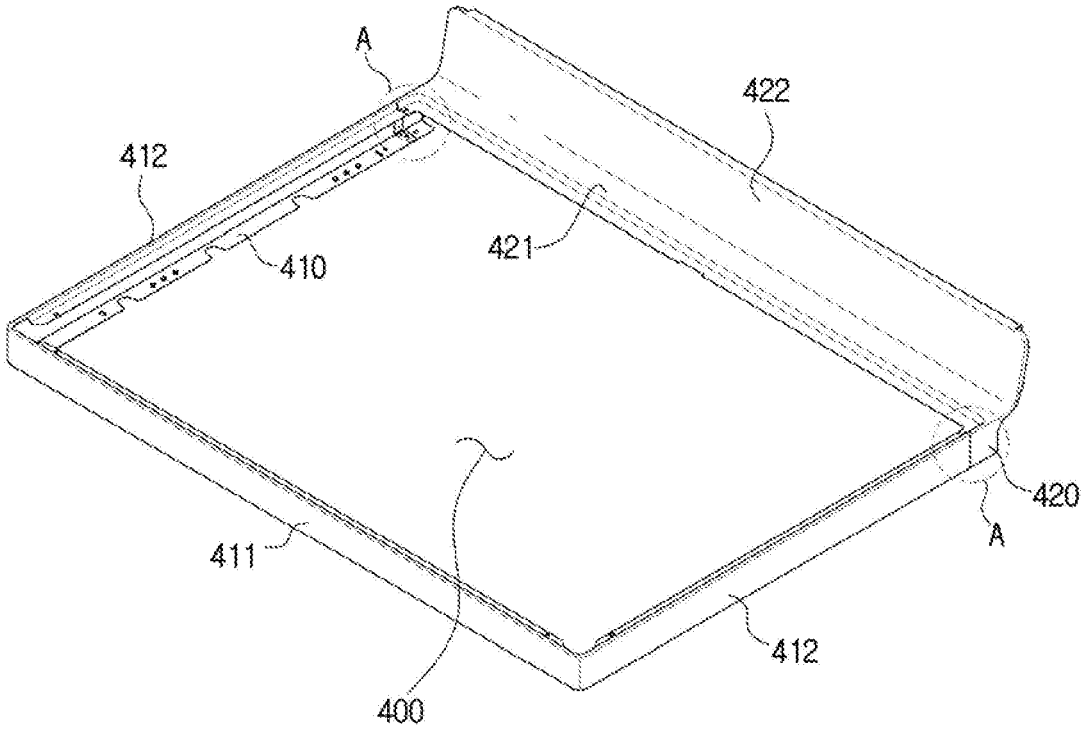

[Fig. 6]
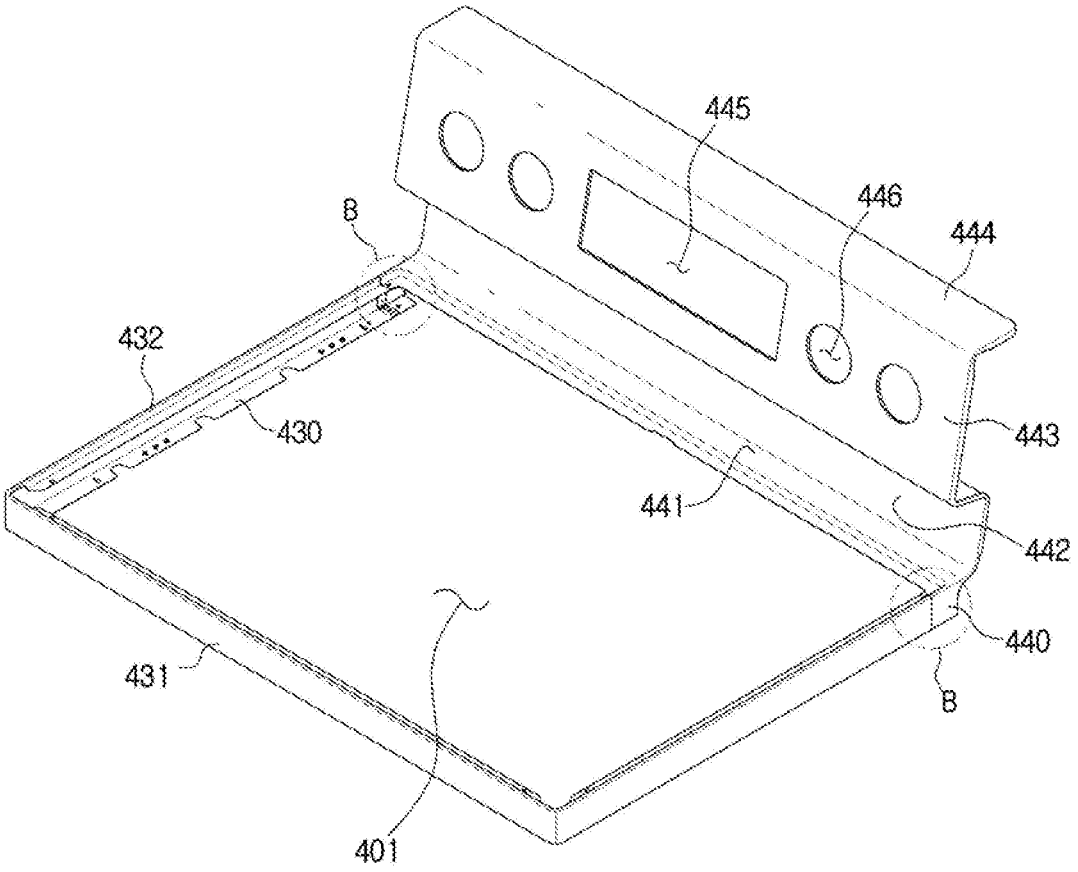

COOKER

TECHNICAL FIELD

The present disclosure relates to a cooker, and more particularly, to a cooker having an improved frame structure.

BACKGROUND ART

A cooker is a home appliance that cooks food using gas or electricity. The cooker may include a cabinet forming the exterior appearance, and a cooktop unit positioned in an upper portion of the cabinet. The cooktop unit may include a heating source such as an induction stove or gas stove.

The cooker may include an oven with the cabinet in which the food is placed and receive power from the outside to cook the food. The oven may be positioned in a lower portion of the cooktop unit.

The cooktop unit may include a frame and a plurality of heating sources installed inside the frame. The frame may include side frames and a top frame. The side frame and the top frame may be formed of stainless steel. The frame may be formed of SPP material coated with enamel. The enamel coating may be formed on a top surface of the top frame. The enamel coating may also be made on an outer surface of the side frame.

By coating the frame with the enamel, a heat resistance can be improved. Furthermore, with the enamel coating layer, the outside of the cooktop unit can be cleaned easily.

The side frame included in the conventional cooktop unit is formed through a notching process by which a frame contour is formed on a predetermined area of a sheet of stainless steel and a drawing process by which the frame is pressed and extended to form a stepped portion of the frame or the like. In addition, a hole is formed by a piercing process in a portion through which a fastening member or the like passes, and a flange or the like is formed by a bending process.

In order to perform the drawing process, a large-sized mold is required. Further, the drawing process requires an expensive material having higher elongation. Therefore, a manufacturing cost of the frame may be increased.

DISCLOSURE

Technical Problem

It is an aspect of the present disclosure to provide a cooker having a frame manufactured using a miniaturized mold and a material having lower elongation.

Additional aspects of the disclosure will be set forth in part in the description which follows and, in part, will be obvious from the description, or may be learned by practice of the disclosure.

Technical Solution

In accordance with an aspect of the present disclosure, a cooker may include a cooktop assembly configured to cook and directly heat a container accommodating food therein. The cooktop assembly may include a side plate provided with at least two frames coupled to each other and a top plate located at an upper portion of the side plate. The side plate may include a first frame including a front surface of the cooktop assembly and a second frame including a rear surface of the cooktop assembly. An end of a side surface of the first frame and a flange of the second frame may be welded together.

The at least two frames may be formed of stainless steel.

The first frame may include the side surface bent from the front surface of the cooktop assembly.

The first frame may include two side surfaces provided on one side and the other side of the front surface of the cooktop assembly and facing each other.

The front surface and the two side surfaces may be formed by bending one frame.

When the flange of the second frame and ends of the two side surfaces of the first frame are coupled to each other, space for accommodating a heating source may be formed by the first frame and the second frame.

One side of the second frame coupled to the side surface of the first frame may form a plane.

An edge formed by the front surface and the side surface of the first frame may be formed to be rounded.

A flange formed at the edge formed by the front surface and the side surface of the first frame may have narrow width than a flange formed at a portion other than the edge formed by the front surface and the two side surfaces of the first frame.

The at least two frames may form the side plate through a cutting process, a bending process, a piercing process and a joining process.

The at least two frames may be formed of SUS 430 material.

The side plate may be formed of a metal material.

The top plate may be coated with enamel.

In accordance with another aspect of the present disclosure, a cooker may include an oven having a cooking chamber, a cooktop assembly located over the oven and configured to directly heat a container accommodating food, and a control unit provided at one side of the cooktop assembly. The cooktop assembly may include a side plate formed by coupling a plurality of frames and a top plate positioned on an upper portion of the side plate.

The plurality of frames forming the side plate may be formed of stainless steel.

The plurality of frames may be formed by cutting, bending and piercing a plurality of sheets of a metal material.

The plurality of frames may be welded to each other to form the side plate.

The plurality of frames may be formed of SUS 430 material.

Advantageous Effects

According to embodiments of the present disclosure, a cooker may have frames forming the sides, which may be easily manufactured, thereby saving the manufacturing cost.

DESCRIPTION OF DRAWINGS

These and/or other aspects of the disclosure will become apparent and more readily appreciated from the following description of the embodiments, taken in conjunction with the accompanying drawings of which:

FIG. 1 is a perspective view of a cooker, according to an embodiment of the present disclosure;

FIG. 2 shows a plurality of sheets for manufacturing at least two frames, according to the embodiment of the present disclosure;

FIG. 3 shows flanges formed by bending the plurality of sheets of FIG. 2;

FIG. 4 shows the plurality of sheets of FIG. 3 bent into the form of the at least two frames;

FIG. 5 shows at least two frames, according to the embodiment of the present disclosure; and FIG. 6 shows at least two frames, according to another embodiment of the present disclosure.

MODES FOR THE INVENTION

Hereinafter, embodiments of the present disclosure will be described in detail with reference to the appended drawings. In the following description, the terms "front end", "rear end", "upper portion", "lower portion", "upper end", and "lower end" are defined based on the drawings, and the shapes and positions of the corresponding components are not limited by the terms.

FIG. 1 is a perspective view of cooker, according to an embodiment of the present disclosure.

As shown in FIG. 1, a cooker 1 may include an oven 10 provided in a lower portion of the cooker 1 and a cooktop assembly 40 provided in an upper portion of the cooker 1. The cooktop assembly 40 may be positioned over the oven 10.

The oven 10 may include a main body 100 having a cooking chamber 20 in which food is placed. The food may be placed in the cooking chamber 20 and the food may be cooked by thermal convection. The cooking chamber 20 may be opened or closed by a door 30. The door 30 may be rotatably positioned in front of the main body 100. The door 30 may be hinged to be rotatable about a hinge portion to open or close the cooking chamber 20.

A window 300 made of a transparent material may be provided on a part of the door 30. A user can check a cooking state of the food placed in the cooking chamber 20 through the window 300. The window 300 may be formed of glass or a plastic material having high heat resistance.

The door 30 may be provided with a handle 31. The user can easily open or close the door 30 by holding the handle 31. As shown in FIG. 1, the handle 31 may protrude forward from the door 30. Alternatively, the handle 31 may be provided in the form of a groove that is formed on a part of a side of the door 30.

Under the cooking chamber 20, a drawer 32 having a receiving portion 320 for storing the food or dishware or the like may be provided. The drawer 32 may be pulled out forward from the main body 10. A heater (not shown) for heating the drawer 32 may be provided in the main body 10. The drawer 32 may be heated by the heater so that the food or the dishware or the like placed in the receiving portion 320 may be kept warm.

FIG. 1 shows the cooker 1 in which the drawer 32 is provided under the cooking chamber 20. However, it is also possible that the entire interior space of the main body 10 is provided as the cooking chamber 20 without the drawer 32.

The cooktop assembly 40 may be positioned over the oven 10. The cooktop assembly 40 may be provided with a heating source capable of heating the food directly. The cooktop assembly 40 may have the form of a gas stove or induction stove. The heating source may be supplied with energy from the outside to cook the food placed on the upper surface of the cooktop assembly 40. Hereinafter, an embodiment in which the cooktop assembly 40 is provided in the form of induction stove will be described.

The cooktop assembly 40 may have a cooking area 44. A container accommodating food may be placed in the cooking area 44 and heated directly. The cooking area 44 may be provided with the heating source having a coil wound several times, so that the container accommodating the food may be heated.

The cooktop assembly 40 may include frames 41 and 42 of stainless steel. A top plate 43 may be seated on the upper portion of the frames 41 and 42. The heating source may be accommodated in space formed by the frames 41 and 42 and top plate 43. The cooking area 44 may be displayed on the top plate 43, and the heating source may be positioned underneath the cooking area 44.

The frames 41 and 42 may be provided by coupling at least two frames. The frames 41 and 42 may be not made integrally by processing a single sheet but may be made by processing two or more sheets. The sheets forming the frames 41 and 42 may be narrow in width and long in length. The shape and size of the sheets forming the frames 41 and 42 may be different from each other.

The frames 41 and 42 may be formed by processing sheets of stainless steel. Since the frames 41 and 42 according to the present disclosure do not undergo a drawing process, the frames 41 and 42 may not necessarily be formed with an expensive material having higher elongation. That is, the stainless steel material that may be processed into the frames 41 and 42 may be a material having lower elongation and lower price.

For an example, the frames 41 and 42 may be formed by processing a sheet of SUS 430 material. The SUS 430 material is a ferritic stainless steel which does not cause corrosion or cracks but has good corrosion resistance. Therefore, the SUS 430 is widely used for manufacturing building interior items, kitchenware and automobile parts.

In the conventional case, a single sheet is formed into a single frame through the drawing process, a notching process, a piercing process, a bending process, etc. In this case, a middle portion, which serves as space for accommodating the heating source or the like, is cut and separated off, leading to material waste.

In a case of the drawing process, a sheet made of a material having higher elongation may be used. A sheet made of a material having a lower elongation may be broken or torn during the drawing process. As described above, the price of the sheet made of the material having higher elongation may be higher than that of the sheet made of the material having lower elongation.

For example, the conventional frame is formed by processing a sheet of SUS 304 material. The SUS 304 material is an austenitic stainless steel having good elongation, providing good processability, high corrosion resistance and good weldability. However, the SUS 304 material is more corrosive than the SUS 430 material and has a higher probability of occurrence of cracks.

Since the sheet made of the SUS 304 material has higher elongation, the drawing process may be easily performed. However, the sheet made of the SUS 304 material has a disadvantage in that it is expensive. In a case of the sheet made of the SUS 430 having lower elongation, a defect such as tearing of edges is likely to occur during the drawing process.

In a case of the present disclosure, an expensive material having higher elongation is not required because the drawing process is not carried out when the frames 41 and 42 are manufactured. Further, at least two sheets may be manufactured into a part of the frames 41 and 42, respectively, thereby preventing material waste.

As described above, according to the present disclosure, a manufacturing cost can be reduced as compared with the conventional case. Further, since it does not require a large-sized mold for the drawing process, it is advantageous in utilization of space in a manufacturing environment, and since an expensive mold is not required, the cost required for a mold can be reduced.

A control unit may be provided behind the cooktop assembly 40. The control unit may include housings 14 and 15 forming the exterior appearance. The housings 14 and 15 may include a first housing 14 forming the rear exterior appearance of the control unit and a second housing 15 forming the front exterior appearance of the control unit. The first housing 14 may be provided to cover side surfaces and a rear surface of the control unit and the second housing 15 may be provided to cover a front surface and an upper surface of the control unit. The shape of the housings 14 and 15 is not limited thereto.

The control unit may include a display unit 11 on which information about an operation or the like of the cooker 1 is displayed and operation units 12 and 13 which may be manipulated by the user to control the operation of the cooker 1. The operation units 12 and 13 may be provided in the form of a button 12 or a knob 13. For an example, an operation of turning on/off the oven 10 or an operation of adjusting a temperature and an operation time of the oven 10 may be performed by the button 12. An operation of the cooktop assembly 40 may be performed by the knob 13. The shape of the operation units 12 and 13 and the means for operating the operation of the cooker 1 are not limited thereto.

The second housing 15 may be detachably provided to facilitate checking and repair of the control unit during use of the cooker 1. The second housing 15 may be provided in a separate and independent configuration from the frames 41 and 42 provided on the cooktop assembly 40 so as to be separated if necessary.

The second housing 15 may be made of the same material as the frames 41 and 42. Also, the handle 31 provided on the door 30 may be made of the same material as the frames 41 and 42. The second housing 15 and the frames 41 and 42 may be made of the same stainless material, so that the exterior appearance of the cooker 1 seems to be luxurious.

In the conventional case, since a frame of the cooktop assembly 40 is made of expensive stainless steel, a manufacturing cost could be increased when a front housing, a handle, etc. of a control unit are made of the same material. However, in the case of the present disclosure, since the second housing 15, the handle 31 and the frames 41 and 42 are implemented with the stainless steel of the lower cost than the conventional one, it is possible to realize a luxurious aesthetic appearance of the cooker 1 with a lower cost than the conventional one.

Hereinafter, a method of manufacturing the frames 41 and 42 provided in the cooktop assembly 40 will be described.

FIG. 2 shows a plurality of sheets for manufacturing at least two frames, according to the embodiment of the present disclosure.

As shown in FIG. 2, the frames 41 and 42 of the cooktop assembly 40 according to the embodiment of the present disclosure may be manufactured using at least two sheets. Hereinafter, a method of manufacturing the frames 41 and 42 using two sheets 41*a* and 42*a* will be described.

A sheet to be processed into the first frame 41 may be referred to as a first unit 41*a* and a sheet to be processed into the second frame 42 may be referred to as a second unit 42*a*.

The first unit 41*a* may be made of the first frame 41 positioned at the front and the side of the cooktop assembly 40. The second unit 42*a* may be made of the second frame 42 positioned at the rear of the cooktop assembly 40.

The first unit 41*a* may be provided somewhat longer than a sum of the length of the front portion of the cooktop assembly 40 in the left and right direction and the length of the both sides of the cooktop assembly 40 in the forward and backward direction. The second unit 42*a* may be provided somewhat longer than the length of the rear of the cooktop assembly 40 in the left and right direction.

The first unit 41*a* and the second unit 42*a* may be made of a metal material that is bendable. For example, the first unit 41*a* and the second unit 42*a* may be made of SUS 430 material. Materials of the first unit 41*a* and the second unit 42*a* are not limited to SUS 430 material, but a case in which the first unit 41*a* and the second unit 42*a* are made of SUS 430 material will be described below.

Edges of the first unit 41*a* may be cut to correspond to the shape of the first frame 41. The first unit 41*a* may be cut to have an area including a portion that may become a flange for coupling with the main body 100 of the cooker 1, the second frame 42 or the like. Portions that become edges between the front and sides of the first frame 41 may be processed to have a narrower width than the other portions of the first frame 41 so that bending of the first unit 41*a* is facilitated.

Edges of the second unit 42*a* may be cut to correspond to the shape of the second frame 42. The second frame 42 may be cut to have an area including a portion that may become a flange for coupling with the main body 100 of the cooker 1, the first frame 41, the first housing 14 of the control unit or the like.

Together with the edge cutting, the first unit 41*a* and the second unit 42*a* may be pierced to form a hole or the like into which a fastening member or the like can be inserted.

FIG. 3 shows the plurality of sheets of FIG. 2 bent to have a flange.

As shown in FIG. 3, after the first unit 41*a* and the second unit 42*a* are cut, the edges of the first unit 41*a* and the second unit 42*a* may be bent to form flanges 410 and 420. A first flange 410 may be formed on the first unit 41*b* and a second flange 420 may be formed on the second unit 42*b*.

FIG. 4 shows the plurality of sheets of FIG. 3 bent in the form of the at least two frames, and FIG. 5 shows the at least two frames, according to the embodiment of the present disclosure.

As shown in FIGS. 4 and 5, the first unit 41*b* may be bent in the form of the first frame 41. The first unit 41*b* may be bent to have two sides facing each other.

A bent first unit 41*c* may form surfaces positioned on the front and both sides of the first frame 41. Specifically, the first unit 41*c* may include a front surface 411 and side surfaces 412 bent from the front surface 411. In this case, edges at which the front surface 411 and the side surfaces 412 are connected may be rounded.

Both ends of one side of the second unit 42*c* may be bent in one direction to form the second flange 420 coupled with the first unit 41*c*.

The second flange 420 may be formed at both ends of one side of the second unit 42*c* and coupled to the first unit 41*c* by being bent in one direction. At the other side of the second unit 42*c*, a connecting unit 422 connected to the control unit and erected upward may be formed.

The first unit 41*c* may be provided to be similar in shape to the first frame 41 through the bending process and the second unit 42*c* may be provided to be similar in shape to the second frame 42.

As shown in FIG. 5, an end of both side surfaces 412 of the first unit 41*c* and the second flange 420 of the second unit 41*c* may be joined together. The end of both side surfaces 412 of the first unit 41*c* and the second flange 420 of the second unit 41*c* may be welded. After the welding is performed, a buffing process may be performed so that a joining portion A of the first unit 41*c* and the second unit 42*c* becomes smooth.

The first unit 41*c* and the second unit 42*c* may be joined by various methods such as joining by an adhesive, joining by a fastening member, or the like as well as welding.

The frames 41 and 42 of the cooktop assembly 40 may be formed by coupling the first unit 41*c* and the second unit 42*c*. In the frames 41 and 42, space 400 may be formed to accommodate the heating source or the like. The frames 41 and 42 may include the front surface 411, the both side surfaces 412 bent from the front surface 411 and the rear surface 421 in the back. The frames 41 and 42 may include the connecting unit 422 bent upward from the rear surface 421. The connecting unit 422 may be provided to be connected to the second housing 15 of the control unit shown in FIG. 1 when the cooker 1 is viewed from the front.

As described above, in a case that the frames 41 and 42 provided in the cooktop assembly 40 are provided using the at least two sheets, it is not necessary to cut and throw away the sheets to form the space for accommodating the heating source or the like. Therefore, waste of the material can be reduced. In addition, since the frames 41 and 42 are manufactured without the drawing process, it is not necessary to provide a large mold for the drawing process. Therefore, it is possible to efficiently utilize space of a workplace and to reduce the cost for providing a mold.

In addition, since the frames 41 and 42 may be formed using a material such as SUS 430 material having relatively small elongation, material cost for manufacturing the frames 41 and 42 can be reduced.

As described above, the frames 41 and 42 of the cooktop assembly 40 may be formed of stainless steel to form the exterior appearance of the cooktop assembly 40, so that the luxurious aesthetic appearance of the cooker 1 can be formed.

FIG. 6 shows at least two frames according to another embodiment of the present disclosure.

As shown in FIG. 6, a frame of a cooktop assembly according to this embodiment of the present disclosure is similar to the frames 41 and 42 of the cooktop assembly 40 disclosed in FIGS. 1 to 5 in that each of at least two sheets is processed to form a portion of a frame. However, the second frame of the cooktop assembly according to this embodiment of the present disclosure is different from the frames 41 and 42 disclosed in FIGS. 1 to 5 in that the second frame disclosed in FIG. 6 is integrally formed with a front housing provided in a control unit.

The frame disclosed in FIG. 6 may include a third frame forming a front surface 431 and both side surfaces 432 and a fourth frame forming a rear surface 441, a front surface 443 of the control unit and an upper surface 444 of the control unit.

A third sheet corresponding to the third frame and a fourth sheet corresponding to the fourth frame may be cut into the shape corresponding to each frame. After the cutting process, the third sheet and the fourth sheet may go through a piercing process to form a hole through which a fastening member or the like can pass and holes 445 and 446 in which a display device, an operation device or the like can be installed.

After the cutting process of the third sheet and the fourth sheet is completed, a bending process may be performed so that a flange is formed. The third sheet and the fourth sheet having the flange may be bent.

The third sheet may be bent to form the front surface of the frame and the both side surfaces of the frame. The fourth sheet may be provided with coupling portions 440. Ends of the coupling portions 440 may be coupled with the third sheet. One side of the fourth sheet may be bent to form a connecting portion 442, the front surface 443 of the control unit and the upper surface 444 of the control unit.

The rear surface 441 of the frame and the front surface 443 of the control unit may be connected by the connecting portion 442. The connecting portion 442 may be bent to be positioned rearward of the front surface 443 of the control unit. The rear surface 441 of the frame, the front surface 443 of the control unit and the connecting portion 442 may be integrally formed.

Ends of the side surfaces 432 of the third frame and the coupling portions 440 of the fourth frame may be welded or connected by an adhesive or a fastening member or the like. In a case that the ends of the side surfaces 432 of the third frame and the coupling portions 440 of the fourth frame are respectively welded together, portions B in which the coupling portions 440 and the ends of the side surfaces 432 of the third frame are connected to each other may each have a smooth surface through a buffering process to be flat. The third frame and the fourth frame may be coupled to form space 401 in which a heating source or the like is received.

Since the frame of the cooktop assembly is provided using the at least two sheets, the sheet may not necessarily be cut for space to accommodate a heating source or the like. In addition, since no drawing process is performed, cost and space required for a mold can be reduced.

In addition, since the frame may be formed using an inexpensive material having lower elongation than of the conventional frame, the material cost can be saved. Since the frame is formed of stainless steel, the exterior appearance of the cooker 1 may have a luxurious look.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A cooker comprising:
an oven having a cooking chamber;
a cooktop assembly located over the oven and configured to heat a container configured to accommodate food therein, the cooktop assembly comprising
first and second frames coupled to each other, the first frame being formed from a first sheet and having an upper portion, the second frame being formed from a second sheet and having an upper portion, and
a top plate seated on the upper portions of the first and second frames,
wherein the first frame includes a front surface and side surfaces of the cooktop assembly and the second frame includes a rear surface of the cooktop assembly and a flange, and
wherein an end of at least one of the side surfaces of the first frame and the flange of the second frame are welded together to form a support for the top plate.

2. The cooker according to claim 1, wherein the first and second frames are formed of stainless steel.

3. The cooker according to claim 1, wherein the first frame comprises the side surfaces being bent from the front surface of the cooktop assembly.

4. The cooker according to claim 1, wherein the side surfaces comprise two side surfaces provided on one side and the other side of the front surface of the cooktop assembly and facing each other.

5. The cooker according to claim 4, wherein the front surface and the two side surfaces are formed by bending the first frame.

6. The cooker according to claim 4, wherein when the flange of the second frame and ends of the two side surfaces of the first frame are welded to each other, a space for accommodating a heating source is formed by the first frame and the second frame.

7. The cooker according to claim 6, wherein one side of the second frame welded to the side surface of the first frame forms a plane.

8. The cooker according to claim 4, wherein an edge formed by the front surface and the side surface of the first frame is formed to be rounded.

9. The cooker according to claim 8, wherein a flange formed at the edge formed by the front surface and the side surface of the first frame has a narrower width than a flange formed at a portion other than the edge formed by the front surface and the two side surfaces of the first frame.

10. The cooker according to claim 1, wherein the first and second frames are formed through a cutting process, a bending process, a piercing process and a joining process.

11. The cooker according to claim 1, wherein the first and second frames are formed of SUS 430 material.

12. The cooker according to claim 1, wherein the first and second frames are formed of a metal material.

13. The cooker according to claim 1, wherein the top plate is coated with enamel.

14. A cooker comprising:

an oven having a cooking chamber;

a cooktop assembly over the oven and configured to heat a container configured to accommodate food; and a control unit provided at one side of the cooktop assembly, wherein the cooktop assembly includes a top plate and first and second frames formed from first and second sheets, respectively, the first and second frames joined together so that the top plate is seated on upper portions of the first and second frames, and wherein the second frame includes a flange which is welded to the first frame.

15. The cooker according to claim 14, wherein the first and second frames are formed of stainless steel.

16. The cooker according to claim 1, wherein the second frame comprises a rear surface, a connecting portion, a front surface of a control unit, and an upper surface of the control unit being integrally formed.

* * * * *